US006969361B2

(12) United States Patent
Hsieh

(10) Patent No.: US 6,969,361 B2
(45) Date of Patent: Nov. 29, 2005

(54) LEG MASSAGE DEVICE

(76) Inventor: Wen-Hsu Hsieh, No. 27, Lane 300, Tianshiang Rd., Changhua (TW)

( * ) Notice: Subject to any disclaimer, the term of this patent is extended or adjusted under 35 U.S.C. 154(b) by 337 days.

(21) Appl. No.: 10/443,346

(22) Filed: May 22, 2003

(65) Prior Publication Data

US 2004/0236257 A1 Nov. 25, 2004

(51) Int. Cl.[7] ..... A61H 15/00; A61H 23/04

(52) U.S. Cl. ..... 601/127; 601/133; 601/134; 601/148

(58) Field of Search ..... 601/24, 26, 27, 601/28, 29, 30, 31, 32, 46, 63, 89–93, 97–99, 601/101, 102, 104, 112, 115, 118, 122, 126, 601/127, 133, 134, 136, 148

(56) References Cited

U.S. PATENT DOCUMENTS 6,213,962 B1 * 4/2001 Shimizu ..... 601/90
6,315,744 B1 * 11/2001 Inaba ..... 601/149
6,491,652 B1 * 12/2002 Hata et al. ..... 601/151
6,551,260 B2 * 4/2003 Suh ..... 601/99
6,599,261 B1 * 7/2003 Chen ..... 601/115
6,629,940 B2 * 10/2003 Shimizu ..... 601/133
2004/0186399 A1 * 9/2004 Tseng ..... 601/112

* cited by examiner

*Primary Examiner*—Danton D. DeMille
*Assistant Examiner*—Quang D. Thanh
(74) *Attorney, Agent, or Firm*—Charles E. Baxley

(57) ABSTRACT

A leg massage device which comprises a power transmission means having an adjusting stand disposed on a chair. On the adjusting stand a driving shaft is defined having a lateral end connected to a power supplier. Two rollers are coaxially disposed at both ends of the driven shaft of the power transmission means, each of which is provided with a pair of opposite discs and a pair of opposite rotor discs respectively. An oscillating board assembly including two outer oscillating boards and two inner oscillating boards which is fixed to the rotor discs of the two rollers respectively in a manner that the outer oscillating boards located opposite to the inner oscillating boards in pairs. Two wheel units are coaxially disposed around the periphery of the two rollers respectively and located between the outer oscillating boards and the inner oscillating boards. Each of the wheel units including a pair of massage members each having a rod inserted therein first and then to be disposed between the discs of the two rollers, such that the wheel units are disposed in an interactive manner.

4 Claims, 11 Drawing Sheets

LEG MASSAGE DEVICE

BACKGROUND OF THE INVENTION

1. Field of the Invention

The present invention relates to a massage device, and more particularly to a leg massage device specially for massaging legs.

2. Description of the Prior Arts

Following the people lay more and more stress on health great variety of massage devices are being developed increasingly. Every kind of massage device has its own specific shape and structure, which also has its own special massage function and effect in pattern of stroking or kneading. Furthermore, the concept of improving health by massaging the acupuncture points has been widely accepted and applied, especially the idea that by massaging the acupuncture points of the legs and soles to activate the functions of the human organs. Due to the quick tempo of life, people don't have enough time to sit down for massaging the acupuncture points of the legs and soles, a great variety of leg massage device or chair arose as require. But still there are some disadvantages in the structure of them need to be improved:

Just as shown in FIG. 1, wherein an oscillating board 90 of a conventional leg massage device has a massage portion 91 being made of soft material with a little hardness. Although it can provide somewhat massage effect, based on the structure design of the oscillating board 90, the massage portion 91 of the oscillating board 90 cannot provide a comfortable and satisfactory press against the leg in case of massage, accordingly failed in providing a comfortable and satisfactory massage effect. That's because the sizes of the human legs are different and also people are found of different oscillating effect, while the massage portion 91 of the oscillating board 90 cannot be adjusted according to needs.

The present invention has arisen to mitigate and/or obviate the afore-described disadvantages of the conventional leg massage device.

SUMMARY OF THE INVENTION

In accordance with one aspect of the present invention, there is provided with a leg massage device which comprises a power transmission means having an adjusting stand disposed on a chair. On the adjusting stand a driving shaft is defined having a lateral end connected to a power supplier and another lateral end connected to a driven shaft, the driven shaft is laterally set with respect to the driving shaft. Two rollers are coaxially disposed at both ends of the driven shaft of the power transmission means, each of which is provided with a pair of opposite discs as well as a pair of opposite rotor discs respectively. The rotor discs are opposite and inclined to each other at a predetermined angle and disposed at the two rollers respectively. An oscillating board assembly including two outer oscillating boards and two inner oscillating boards which is fixed to the rotor discs of the two rollers respectively in a manner that the outer oscillating boards corresponding to the inner oscillating boards in pairs. At the corresponding inner side of the respective inner/outer oscillating boards an inflatable air bag is defined and a groove defined at its bottom respectively. Two wheel units are coaxially disposed around the periphery of the two rollers respectively and located among the corresponding inner/outer oscillating boards. Each wheel unit including a pair of massage members each of which having a rod inserted therein and then to be disposed between the discs of the two rollers, such that the wheel units are disposed in an interactive manner.

The primary object of the present invention is to provide a leg massage device which is capable of providing a comfortable and effective massage on the legs and soles according to the user's legs sizes and different needs on massage.

Another object of the present invention is to provide a leg massage device which can be disposed on a chair so as to provide the chair additionally with a massage function.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENT

Figure 1:
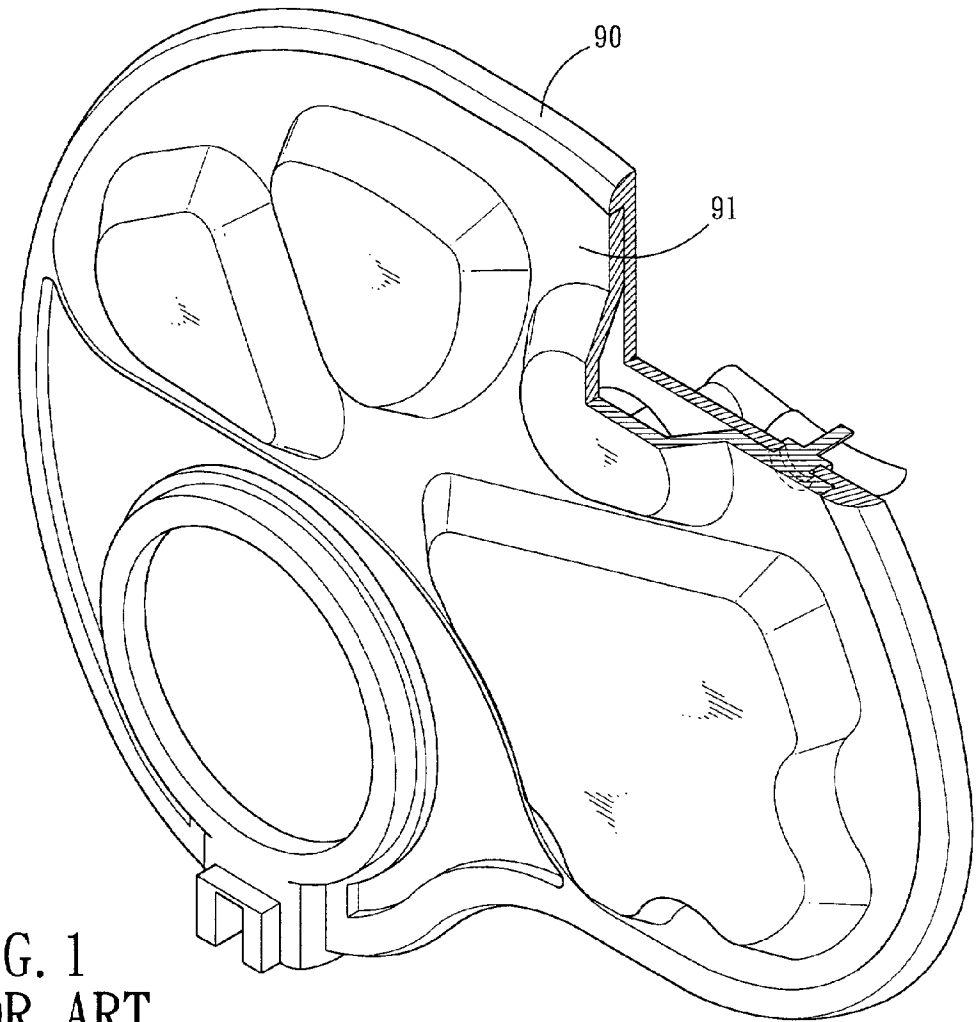
FIG. 1 PRIOR ART
FIG. 1 is a perspective view, partly in section, of an oscillating board of a conventional massage device.
Figure 2:
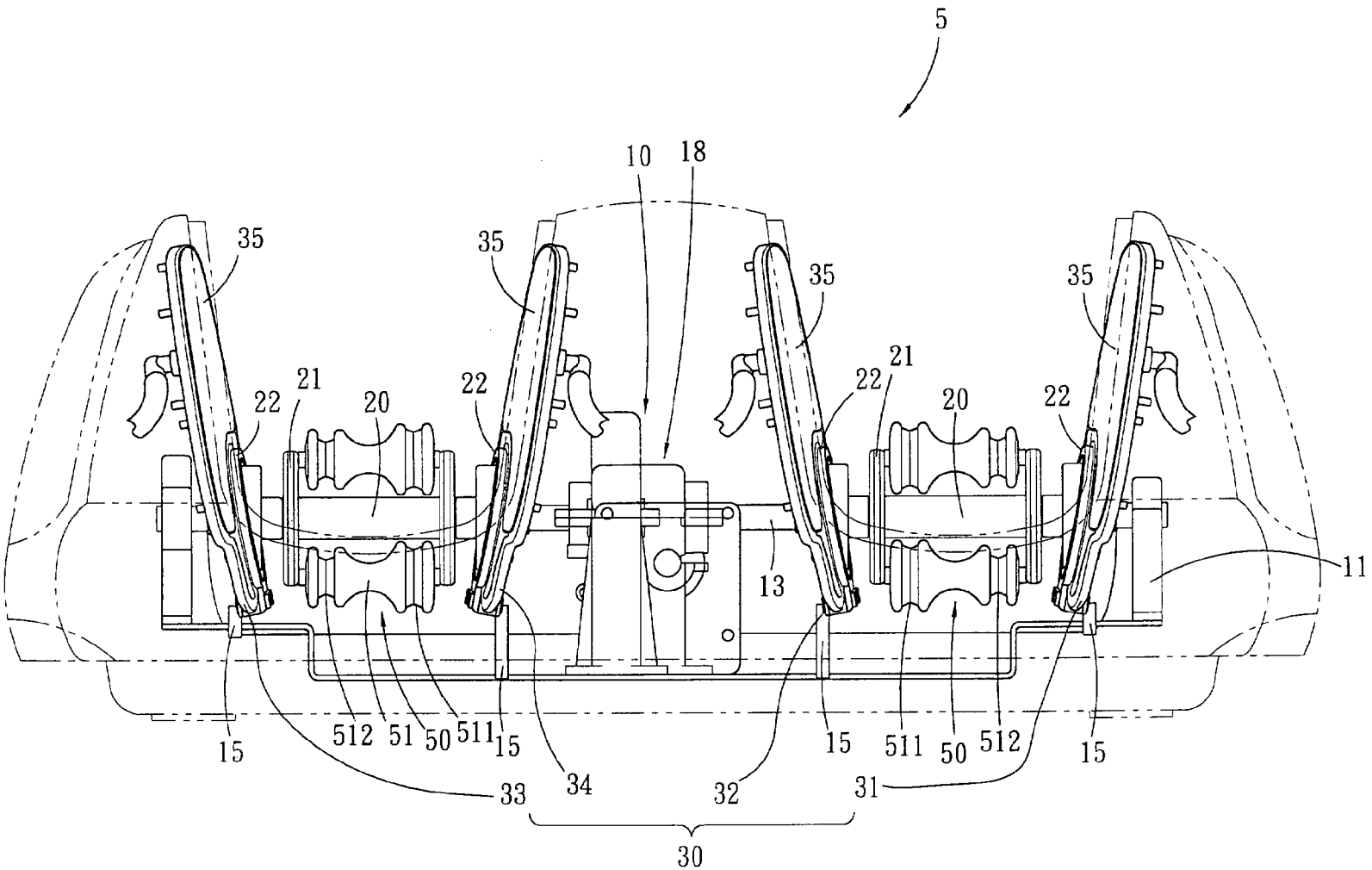
FIG. 2 is a front view of a leg massage device in accordance with a preferred embodiment of the present invention.

Referring first to FIGS. 2–5, wherein a leg massage device 5 in accordance with a preferred embodiment of the present invention can be operated by being disposed on a chair 6 where the legs placed or set alone, which generally comprises a power transmission means 10, a pair of rollers 20, a pair of wheel units 50 and an oscillating board assembly 30 consisting of a pair of outer oscillating boards 31, 33 and a pair of inner oscillating boards 32, 34.

The power transmission means 10 is fixed to the chair 6 by virtue of an adjusting stand 11, through the adjusting stand 11, the leg massage device 5 can be adjusted properly for laying legs therein in a flat manner or hanging down over there. On the adjusting stand 11 thereof a driving shaft 12 is disposed having a gearing set 18 provided at a predetermined position. The gearing set 18 has a first lateral end connected to power supplier and a second lateral end connected to a driven shaft 13, the driven shaft 13 is laterally set with respect to the driving shaft 12. Furthermore, the power transmission means 10 is further provided at a predetermined position thereof with a sensor 16.

Figure 3:
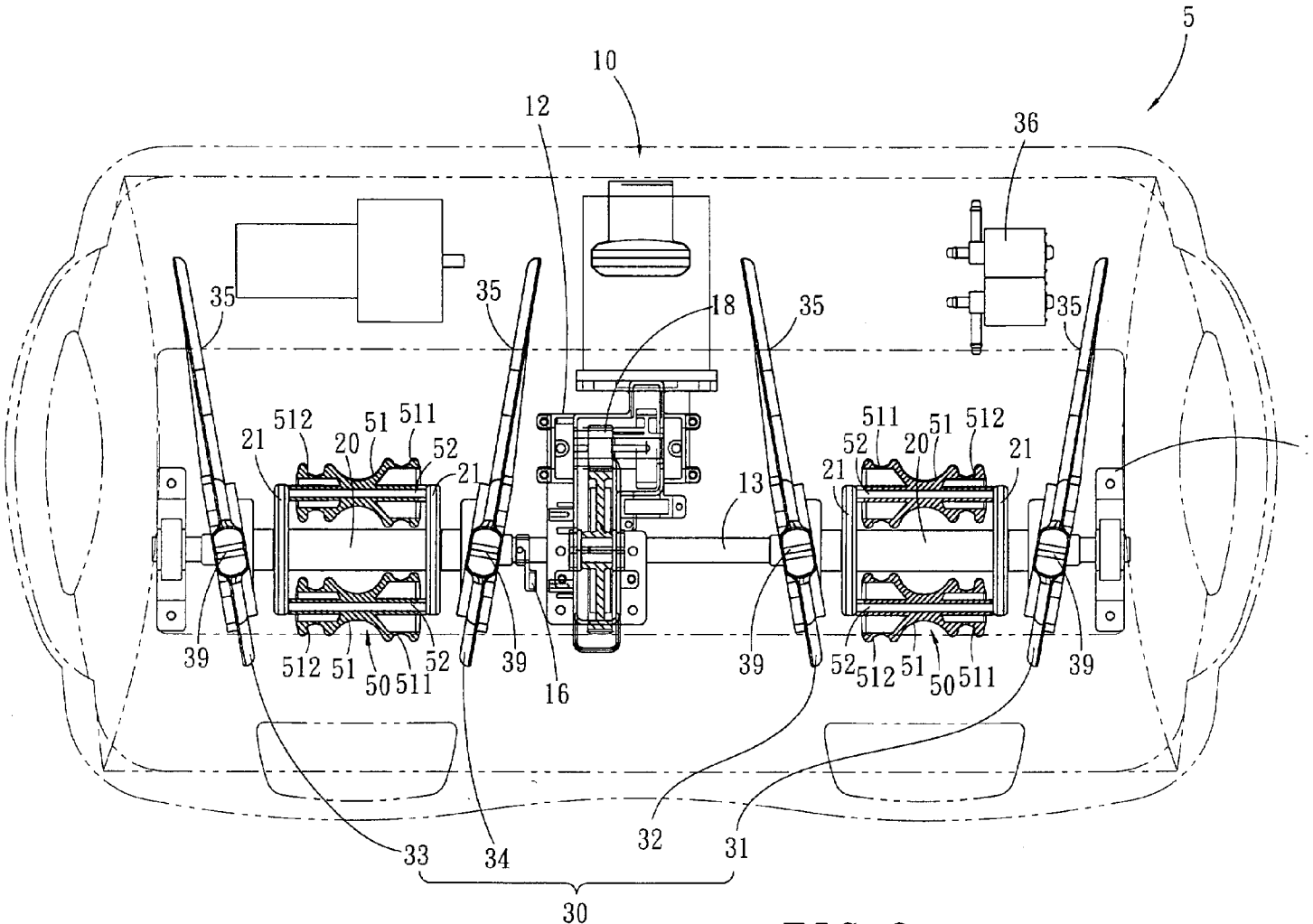
FIG. 3 is a cross sectional view of the leg massage device in accordance with a preferred embodiment of the present invention.
Figure 4:
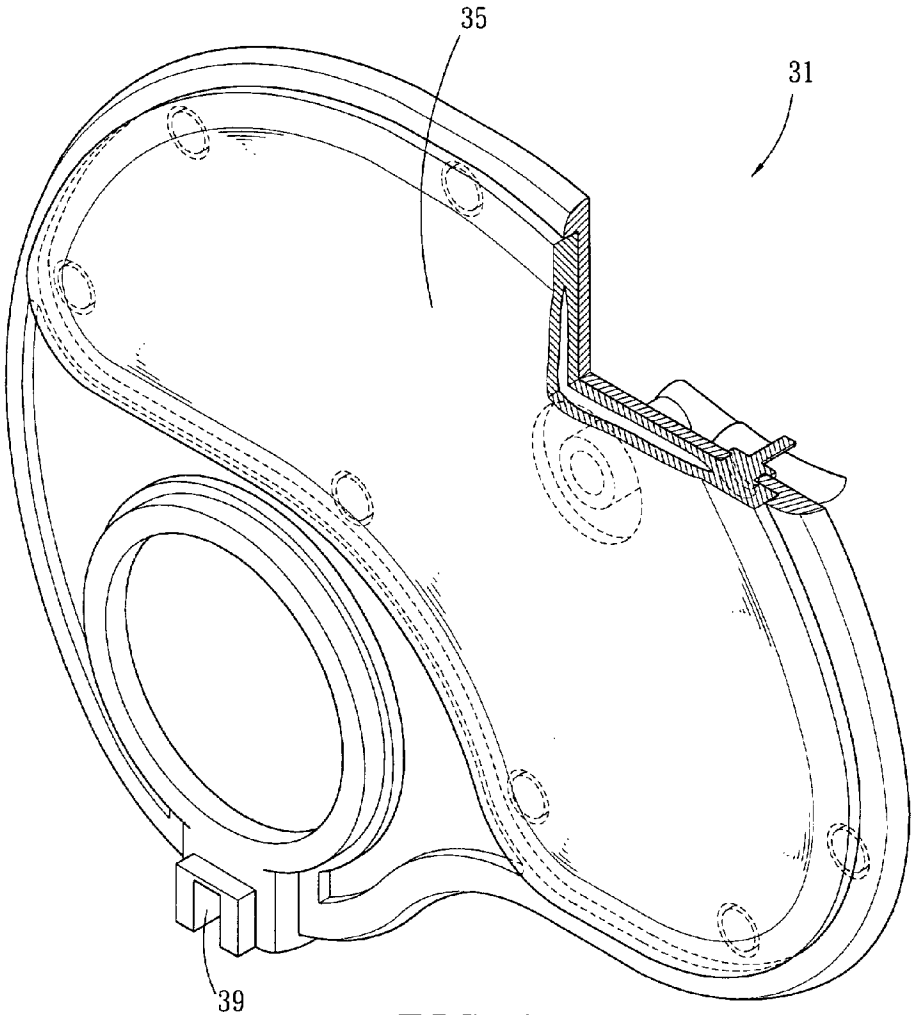
FIG. 4 is a perspective view of an oscillating board of the leg massage device in accordance with a preferred embodiment of the present invention with showing a partial cross sectional view of the same.

On the adjusting stand 11 of the power transmission means 10 four short rods 15 are disposed respectively, each of the short rods 15 has a top end received in a groove 39 (as shown in FIG. 3) formed in the inner/outer oscillating boards 32, 34, 31, 33 of the oscillating board assembly 30 respectively such that the respective inner/outer oscillating boards 32, 34, 31, 33 can keep a distance to the four short rods 15 of the adjusting stand 11 in case of movement.

The two rollers 20 are coaxially disposed at both ends of the driven shaft 13 of the power transmission means 10, each of which is provided with a pair of opposite discs 21 as well as a pair of opposite rotor discs 22 respectively. The rotor discs 22 are opposite and inclined to each other at a predetermined angle and disposed at the two rollers 20 respectively.

The oscillating board assembly 30 includes two outer oscillating boards 31, 33 and two inner oscillating boards 32, 34 which is fixed to the rotor discs 22 of the two rollers 20 respectively in a manner that the outer oscillating board 31 locates opposite to the inner oscillating board 32 and the outer oscillating board 33 locates opposite to the inner oscillating board 34 respectively. The inner/outer oscillating boards 32, 34, 31, 33 are provided at the corresponding inner sides with an inflatable air bag 35 and at its bottom with a groove 39 respectively.

By virtue of an inflator 36 disposed at the chair 6 and under control of a push button together with signal wire (not shown) the air bags 35 of the oscillating board assembly 30 can be inflated according the user's needs, such that the legs can be pressed moderately from both sides by the outer oscillating boards 31, 33 and the inner oscillating boards 32, 34 respectively.

The two wheel units 50 are coaxially disposed around the periphery of the two rollers 20 respectively and located between the outer/inner oscillating boards 33 and 34, 31 and 32 respectively. Each of the wheel units 50 including a pair of massage members 51 each having a rod 52 inserted therein and then to be disposed between the disc 21 of the two roller 20 respectively, such that the wheel units 50 are disposed in an interactive manner. Each massage member 51 is provided at both ends thereof with a big boss 511 and a small boss 512, both of the bosses 511 and 512 are approximately loop-shaped. In addition, the two massage members 51 of the respective wheel units 50 are equally space apart disposed at 180 degree.

Figure 5:
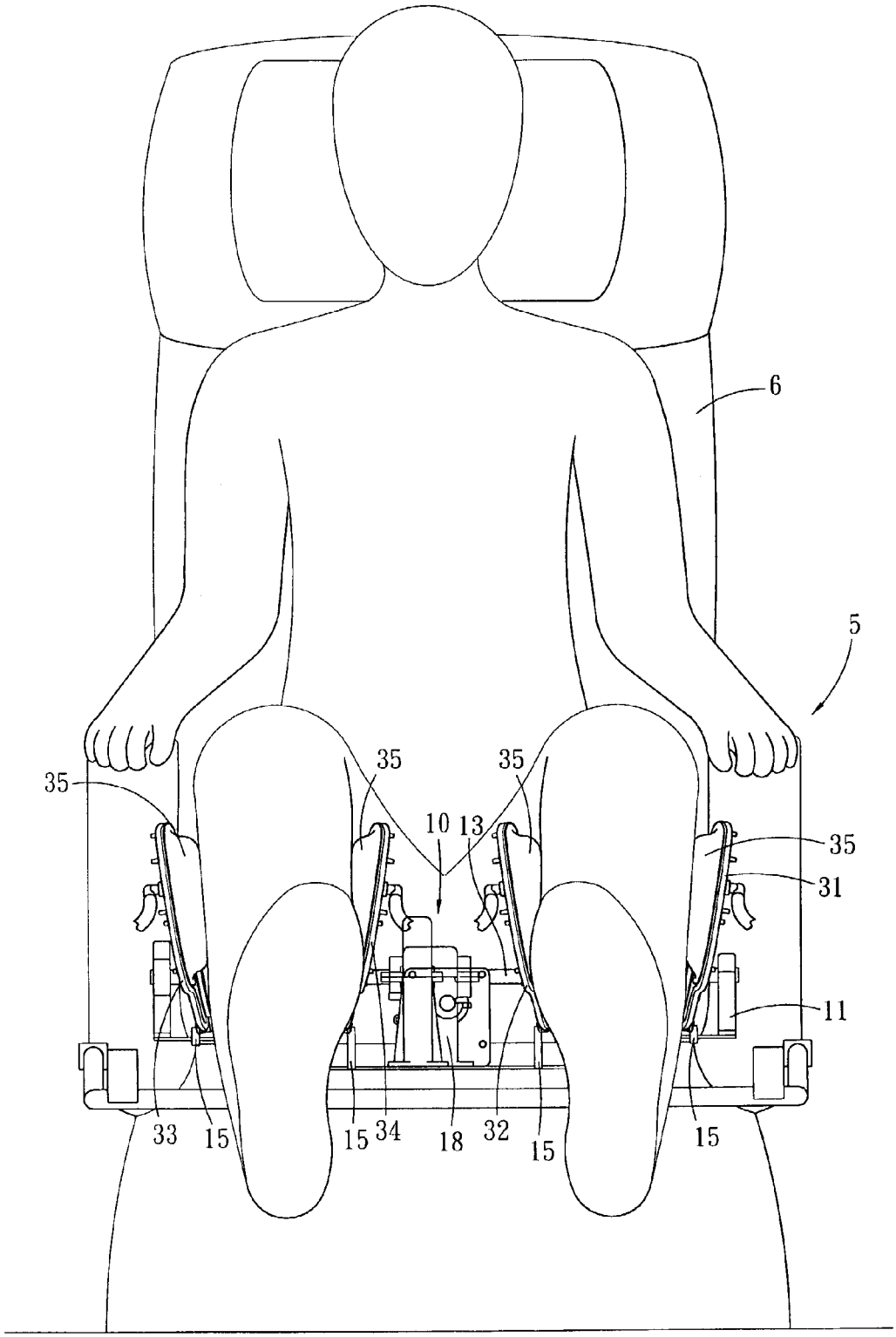
FIG. 5 is an illustrative view of the leg massage device in accordance with a preferred embodiment of the present invention, showing the user's stretching legs out and disposing on the leg massage device of the present invention.
Figure 6:
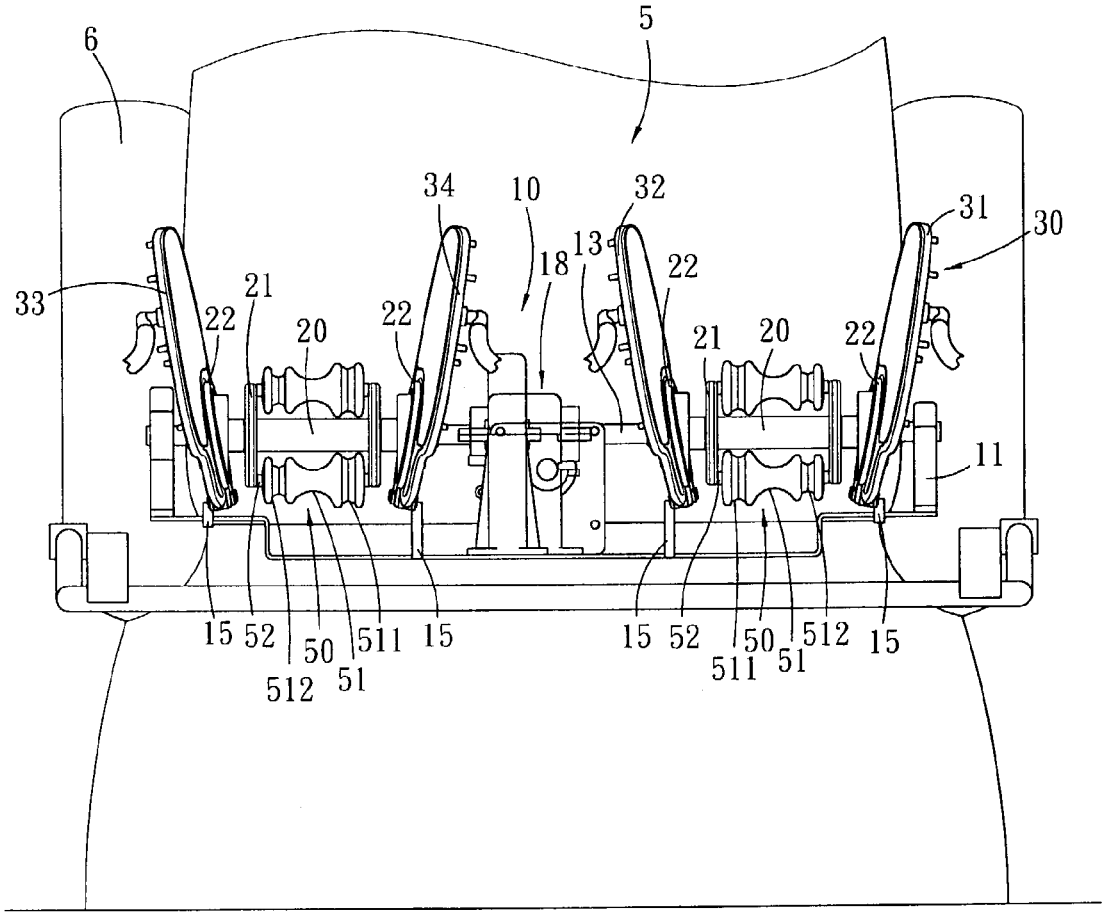
FIGS. 6–10 show operation process of the leg massage device of the present invention disposed on a chair.
Figure 7:
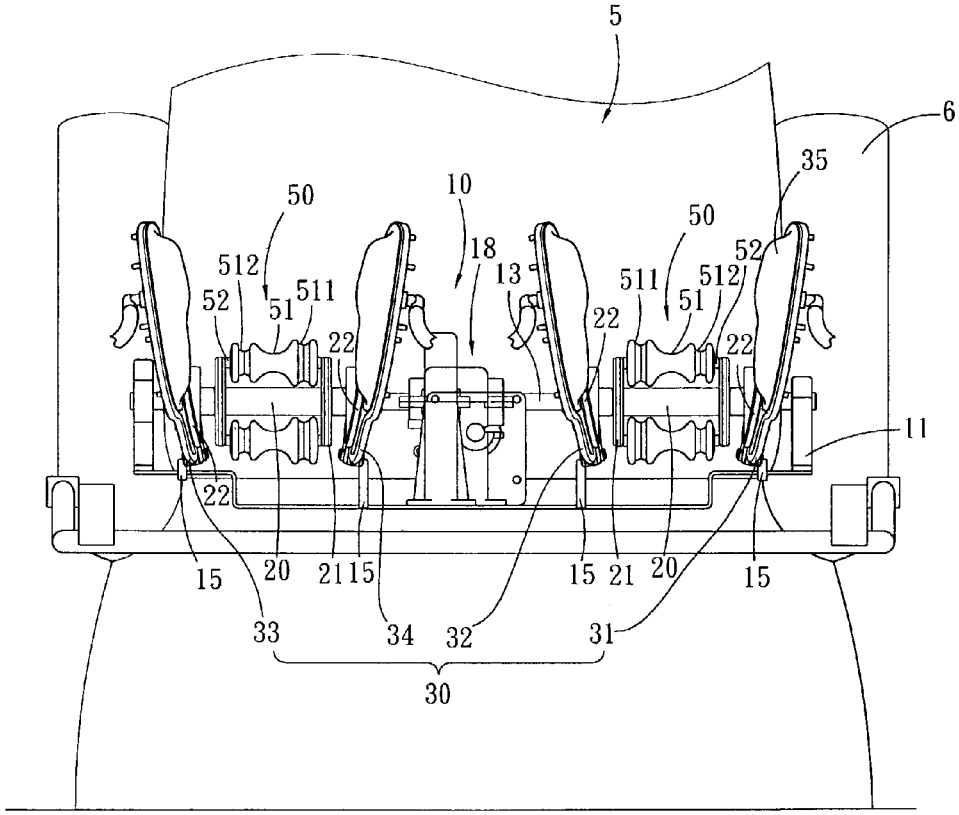
Figure 8:
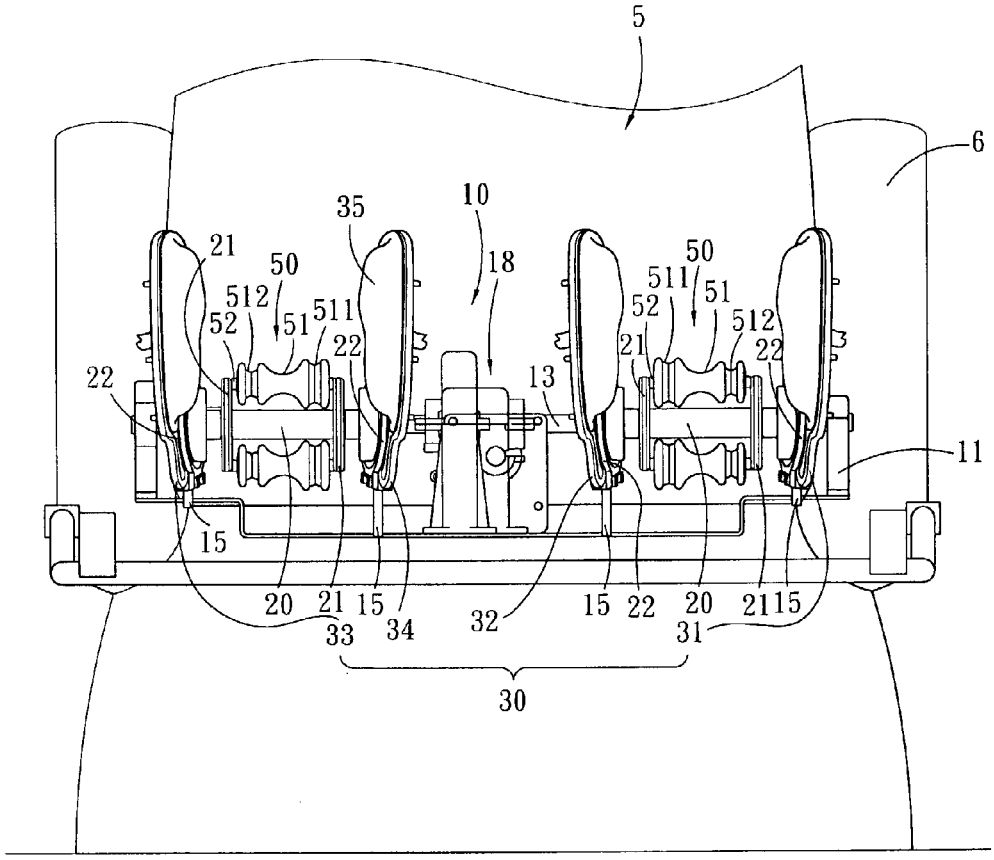
Figure 9:
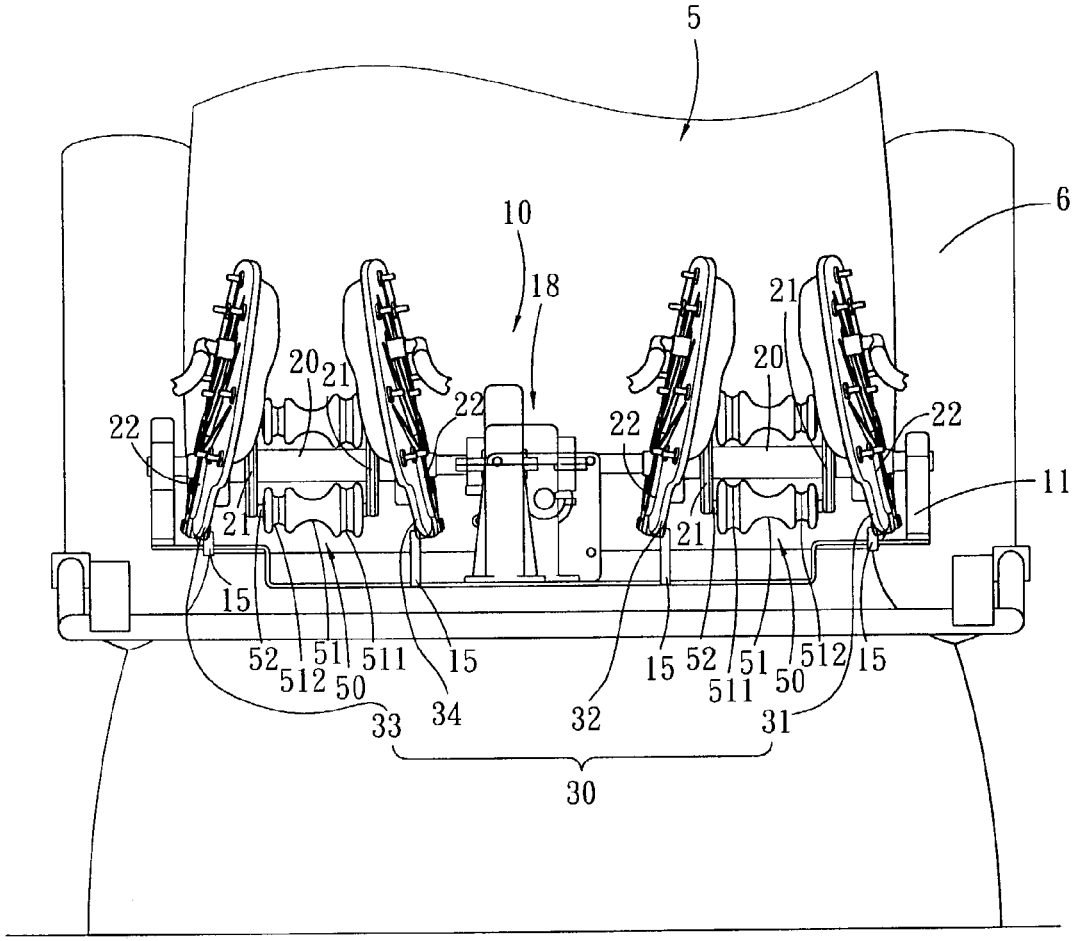

Referring now to FIG. 5 with reference to FIGS. 6 to 11, in which, if want to dispose the legs in the oscillating board assembly 30 to be massaged in a straight stretching way, the user can adjust the adjusting stand 11 of the power transmission means 10 to raise it up such that the legs may be stretched out and disposed in the oscillating board assembly 30 (as shown in FIG. 5).

Then the user can take advantage of the inflator 36 to inflate the air bags 35 so as to make the two outer oscillating boards 31, 33 together with the two inner oscillating boards 32, 34 press the legs front both sides moderately based on the sizes of the legs. At the moment, the user can turn on the power transmission means 10 of the leg massage device 5 so as to effect movement of the inner oscillating boards 32, 34 as well as the outer oscillating boards 31, 33 of the oscillating board assembly 30. Due to the special structure design of the rotor discs 22 of the rollers 20 together with the cooperation between the outer oscillating boards 31, 33 and the inner oscillating boards 32, 34, the outer oscillating boards 31, 33 and the inner oscillating boards 32, 34 are capable of swaying reciprocally left to right in a stroking and kneading pattern, meanwhile, the two massage members 51 of the two wheels units 50 are allowed to rotate and taking advantage of the small and big bosses 511, 512 to massage the legs (with reference to FIGS. 6 to 10). By such arrangements, through the stroking and kneading movement of the leg massage device together with the massage of the wheel units 50, the legs are effectively massaged and further its respective acupuncture points are stimulated, such that achieved the purpose of circulating the vital energy and blood in the legs, providing a massage with different pattern and feeling.

In case that the leg massage device 5 is stopped the inflator 36 will deflate the air bags 35 of the oscillating board assembly 30 immediately, at the same time, the sensor 16 of the power transmission means 10 disposed on the driven shaft 13 serves to transmit signals, in case of enclosed state of the respective oscillating boards of the oscillating board assembly 30, for instructing the outer oscillating boards 31, 33 and the inner oscillating boards 32, 34 to return to open state so as to release the legs from the leg massage device 5.

Figure 10:
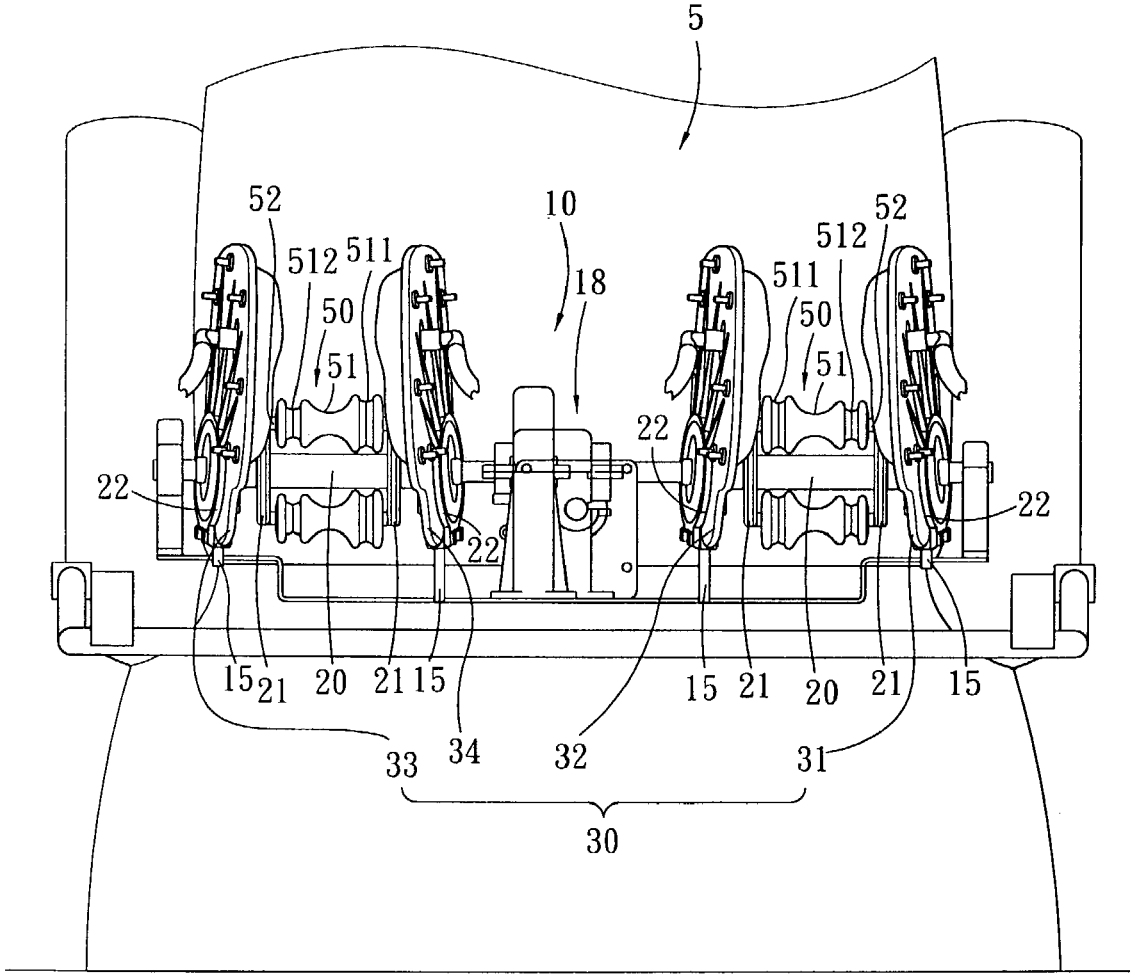
Figure 11:
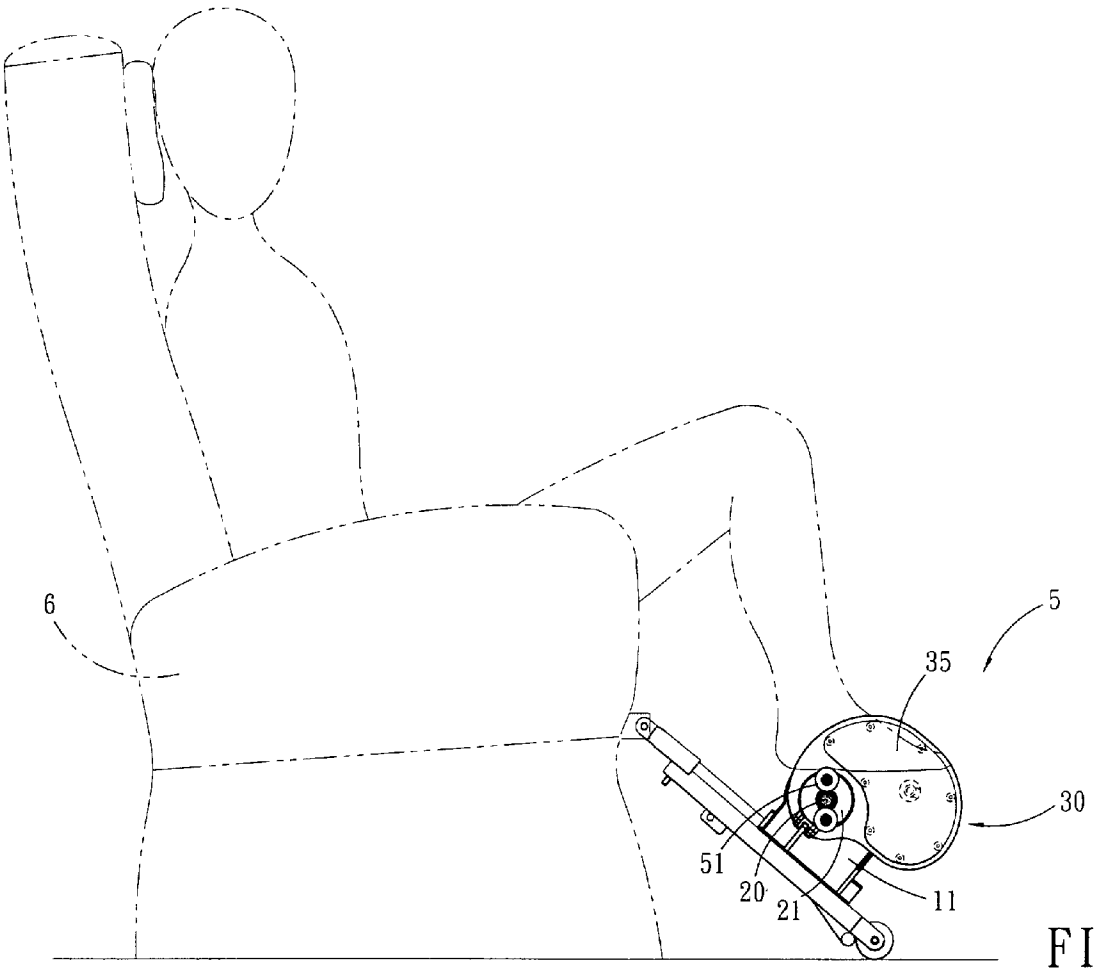
FIG. 11 is an illustrative view of the leg massage device in accordance with a preferred embodiment of the present invention disposed on the chair and showing legs and soles of the user are being massaged.

The leg massage device 5 in accordance with a preferred embodiment of the present invention can be adjusted to provide another pattern of massage according to needs, as shown in FIG. 10, in which, the adjusting stand 11 of the power transmission means 10 is hanged down, thus the user is able to put the ankles of the feet between the inner and outer oscillating boards 32, 34 and 31, 33, such that the ankles as well as the sole can be massaged.

It will be noted that the inflator 36 of the leg massage device 5 and the signals of starting the massage operation are connected and controlled by signal wire together with control device of a push button, so as to control the operation of the leg massage device 5. But in real operation, the control device can be in many other forms, such as switch control, control box, control knob and so on, or can be combined them together in single control box for facilitating the control.

While we have shown and described various embodiments in accordance with the present invention, it should be clear to those skilled in the art that further embodiments may be made without departing from the scope of the present invention.

What is claimed is:

1. A leg massage device comprising:

a power transmission means fixed to a chair by virtue of an adjusting stand, on the adjusting stand thereof a driving shaft disposed which has a first lateral end connected to power supplier and a second lateral end connected to a driven shaft, the driven shaft being laterally set with respect to the driving shaft;

two rollers coaxially disposed at both ends of the driven shaft of the power transmission means, each of which is provided with a pair of opposite discs as well as a pair of opposite rotor discs respectively, the rotor discs being opposite and inclined to each other at a predetermined angle and disposed at the two rollers respectively;

an oscillating board assembly including two outer oscillating boards and two inner oscillating boards which are fixed to the rotor discs of the two rollers respectively in a manner that the outer oscillating boards correspond to the inner oscillating boards in pairs, the inner and outer oscillating boards provided at the corresponding inner sides with an inflatable air bag and at its bottom with a groove defined respectively;

two wheel units disposed around the periphery of the two rollers respectively and located between each pair of the outer and the inner oscillating boards respectively, each of the wheel units including a pair of massage members each of which has a rod inserted therein and then disposed between the discs of the two rollers;

on each corresponding inner side of the respective inner/outer oscillating boards of the oscillating board assembly provided with the inflatable air bag, by such arrangement, when the user adjusts the adjusting stand of the power transmission means to raise it up properly and disposing the legs among the inner and outer oscillating boards, he/she being able to inflate the air bags whereby the corresponding inner/outer oscillating boards can press the legs moderately from both sides and at the same time can simultaneously sway reciprocally left to right in a stroking and kneading pattern so as to massage the legs as well as soles effectively.

2. The leg massage device as claimed in claim 1 further comprising an inflator disposed on the chair for enabling the user to inflate the air bags of the oscillating board assembly according to his needs, whereby, based on real size, his legs can be pressed moderately from both sides by the two oscillating board assemblies.

3. The leg massage device as claimed in claim 1 further comprising four short rods defined on the adjusting stand, each of the short rods having a top end received in a groove formed at the bottoms of the inner oscillating boards and the outer oscillating boards of the oscillating board assembly respectively, such that the respective inner/outer oscillating boards can keep a distance to the four short rods in case of movement.

4. The leg massage device as claimed in claim 1 further comprising a sensor disposed on a predetermined position of the driven shaft serving to transmit signals for instructing the outer oscillating boards and the inner oscillating boards to return to open state in case of enclosed state of the respective oscillating boards of the oscillating board assembly whereby to release the legs from the leg massage device.

* * * * *